US007947344B2

(12) United States Patent
Miller

(10) Patent No.: US 7,947,344 B2
(45) Date of Patent: May 24, 2011

(54) ARTIFICIAL FRUIT APPARATUS

(76) Inventor: Judith J. Miller, Saint John, KS (US)

( * ) Notice: Subject to any disclaimer, the term of this patent is extended or adjusted under 35 U.S.C. 154(b) by 409 days.

(21) Appl. No.: 12/205,367

(22) Filed: Sep. 5, 2008

(65) Prior Publication Data

US 2010/0062193 A1 Mar. 11, 2010

(51) Int. Cl.
*A01N 3/00* (2006.01)

(52) U.S. Cl. ..... 428/21; D11/130; D11/139; D11/146; D11/148

(58) Field of Classification Search ..... 428/19, 428/21; D11/117, 139, 130, 146, 148
See application file for complete search history.

(56) References Cited

U.S. PATENT DOCUMENTS 3,189,508 A 6/1965 Burnbaum
5,084,296 A 1/1992 Lugay et al.
5,858,485 A 1/1999 Chou et al.

FOREIGN PATENT DOCUMENTS

EP 1 431 313 A1 6/2004

*Primary Examiner* — Cathy Lam
(74) *Attorney, Agent, or Firm* — Dale J. Ream

(57) ABSTRACT

An artificial banana apparatus includes a plurality of artificial banana bodies, each artificial banana body being elongate and curved, each artificial banana body having a stem end and an opposed tip, and each stem end having a channel. The banana apparatus including a plurality of elongate stems, each stem having a first end telescopically received in a respective channel to allow a length of the stem outside said artificial banana body to be adjusted, each stem having a second end with a magnetic element. The apparatus includes a stem hub having at least one magnetic element complementary to the stem magnetic elements to removably couple the stems to the stem hub, the stem hub having at least two rows of sockets complementary to the stem second ends to receive the stem second ends in at least two rows.

18 Claims, 5 Drawing Sheets

ARTIFICIAL FRUIT APPARATUS

BACKGROUND OF THE INVENTION

This invention relates generally to decorative imitation fruit and, more particularly, to an artificial fruit apparatus having modular components that enable various fruit configurations to be displayed.

Imitation or decorative fruit provides the advantage of having fruit arrangements on display in one's kitchen or dining areas that do not decay over time as is the case with authentic fresh fruit. For example, artificial grapes or bananas are popular forms of imitation fruit that are often positioned for display on a kitchen counter or dining room table. A consumer may purchase various arrangements of fruit for decorative purposes, such as grapes lying in a bowl, a bunch of bananas for a table display, or an assortment of fruit in a basket. Although assumably effective for their intended purposes, the existing forms of artificial fruit may not be adjustable into user defined configurations or displayed both on a flat surface as well as on an elevated apparatus. Currently, the only way to vary the configuration or display of artificial fruit is to purchase the newly desired configuration.

Therefore, it would be desirable to have an artificial fruit apparatus having multiple artificial fruit bodies that may be adjusted and assembled into user selected configurations. Further, it would be desirable to have an artificial fruit apparatus in which assembled fruit body arrangements may be selectively displayed on a flat surface or on a display stand. In addition, it would be desirable to have an artificial fruit apparatus having magnetic elements for securing artificial fruit bodies in a user selected configuration.

SUMMARY OF THE INVENTION

An artificial banana apparatus according to a preferred embodiment of the present invention includes a plurality of artificial banana bodies, each artificial banana body being elongate and curved, each artificial banana body having a stem end and an opposed tip, and each stem end having a channel. The banana apparatus includes a plurality of elongate stems, each stem having a first end telescopically received in a respective channel to allow a length of the stem outside said artificial banana body to be adjusted, each stem having a second end with a magnetic element. The apparatus includes a stem hub having at least one magnetic element complementary to the stem magnetic elements to removably couple the stems to the stem hub, the stem hub having at least two rows of sockets complementary to the stem second ends to receive the stem second ends in at least two rows.

Therefore, a general object of this invention is to provide an artificial banana apparatus that is adjustable and modular for selective arrangement in various configurations.

Another object of this invention is to provide an artificial banana apparatus, as aforesaid, that may be selectively displayed on a flat surface or on a display stand.

Still another object of this invention is to provide an artificial banana apparatus, as aforesaid, having a stem hub for receiving individual banana body stems.

Yet another object of this invention is to provide an artificial banana apparatus, as aforesaid, having magnetic elements for selectively securing banana bodies in the stem hub.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

An artificial fruit apparatus will now be described in detail with reference to FIG. 1 through FIG. 5 of the accompanying drawings. More particularly, an artificial fruit apparatus 100 includes a plurality of artificial fruit bodies 110, a plurality of artificial stems 120, and a stem hub 130.

Figure 1:
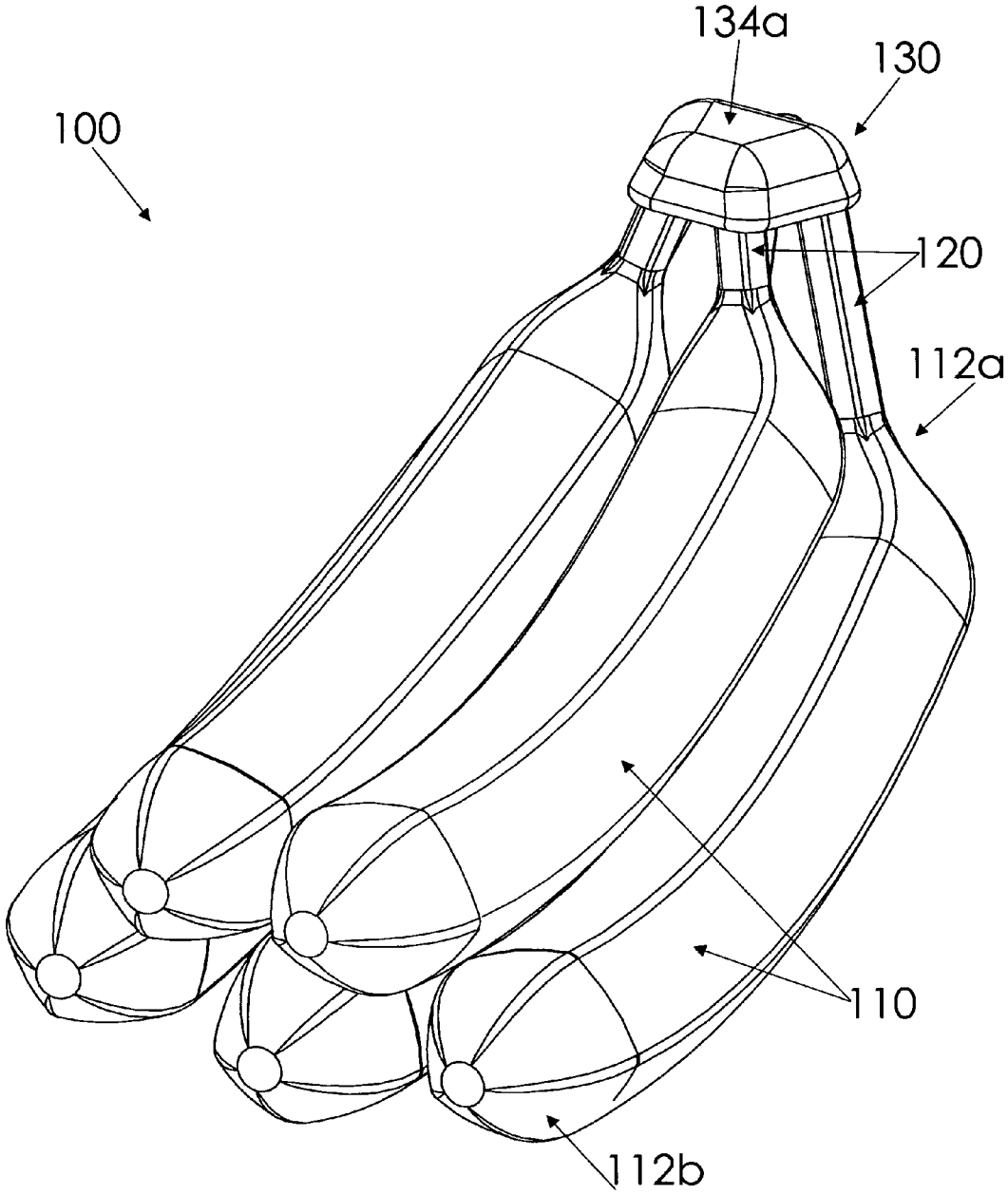
FIG. 1 is a perspective view of an artificial fruit apparatus according to a preferred embodiment of the present invention.

As shown in FIG. 1, each artificial fruit body 110 has a stem end 112*a* and an opposed tip 112*b* (also referred to herein as proximal and distal ends, respectively). Each body 110 may be an banana body (i.e., be configured to resemble a banana), as shown throughout the drawings, though other fruit bodies may alternately be depicted. To represent a banana, each body 110 may be elongate and curved and appropriately colored. The bodies 110 may be constructed of plastic, wood, metal, and/or other appropriate materials. It may be desirable to use materials that simulate the tactile properties of the represented fruit (e.g., real bananas).

Figure 3A:
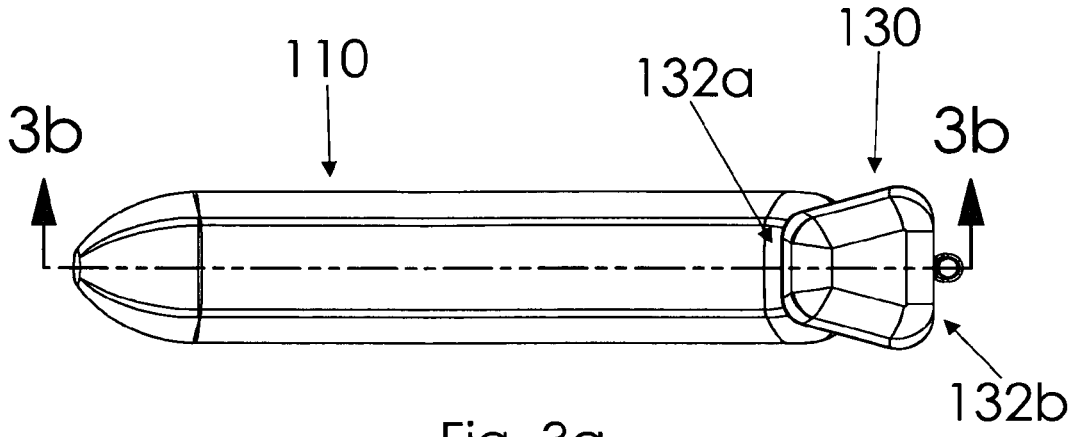
FIG. 3*a* is a top view of the banana body and stem hub as in FIG. 2.
Figure 3B:
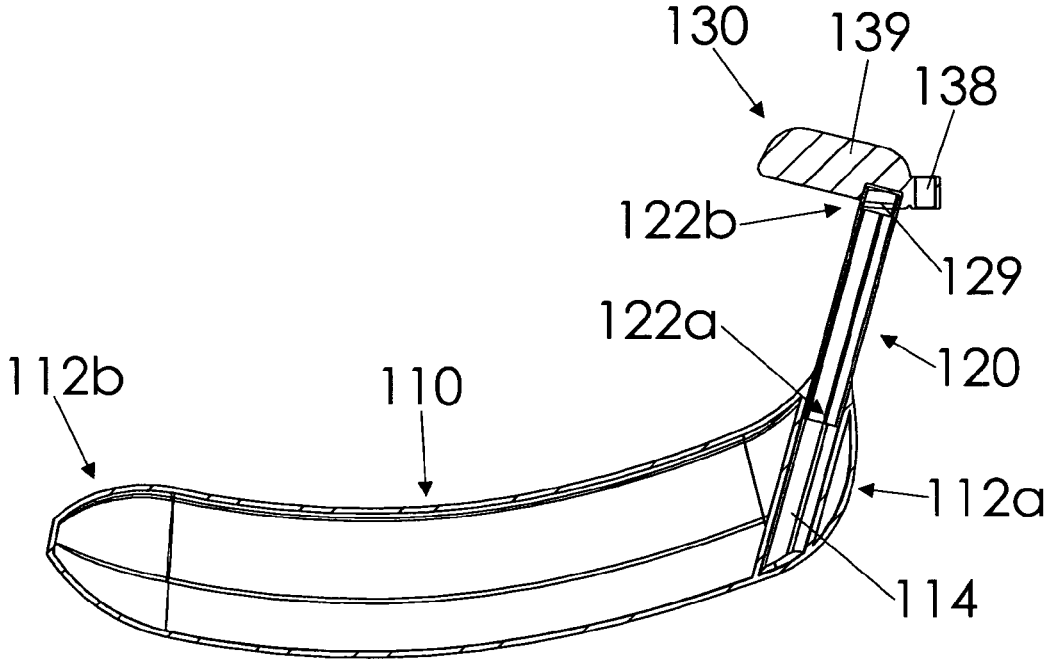
FIG. 3*b* is a sectional view taken along line 3*b*-3*b* of FIG. 3*a;*
Figure 4:
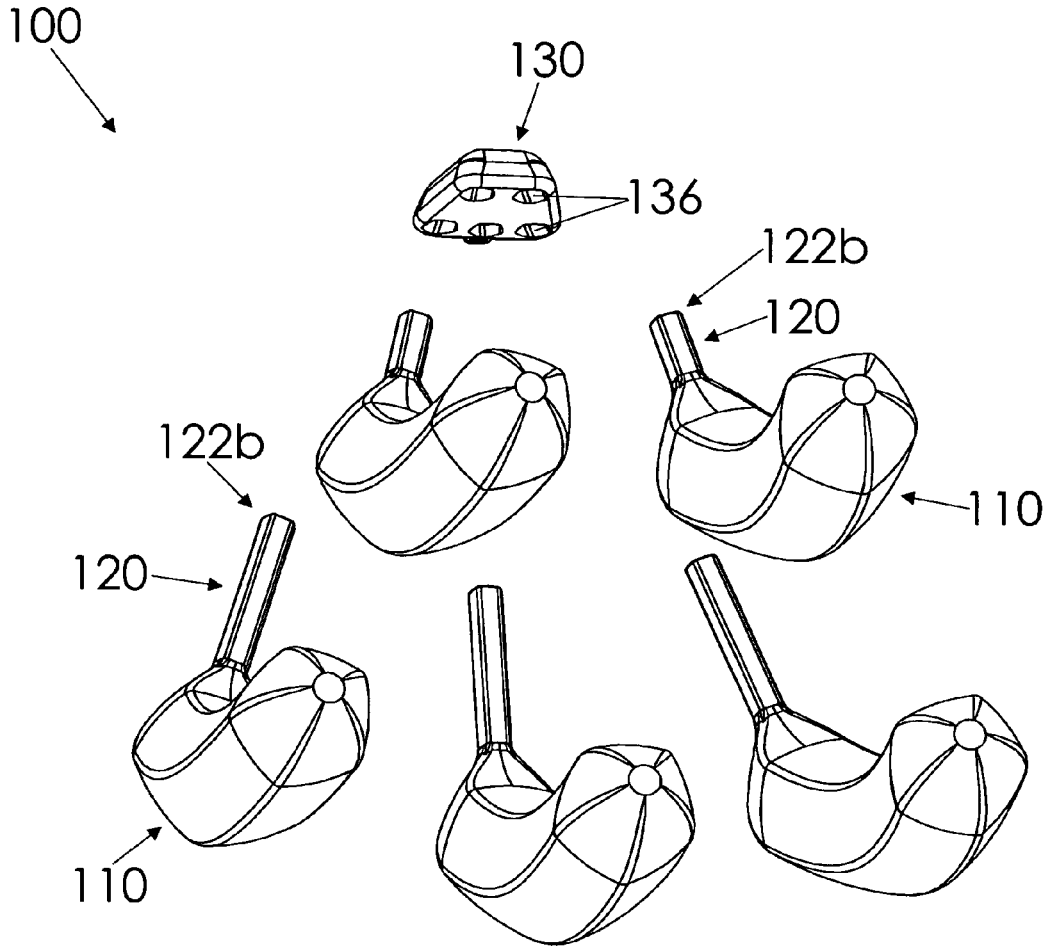
FIG. 4 is an exploded view of the banana apparatus as in FIG. 1.

Each stem end 112*a* may telescopically receive a respective stem 120 to allow a length of the stem 120 outside the body 110 to be altered. More particularly, as shown in FIG. 3*b*, each stem end 112*a* may have a channel 114; each stem 120 may be elongate, generally linear, and have first and second ends 122*a*, 122*b*; and each stem first end 122*a* may be telescopically received in a respective channel 114. The telescopic interaction may be a friction fit, and the friction fit may maintain desired configurations between the stems 120 and bodies 110. In other words, the friction fit may maintain a desired length of each stem 120 outside respective bodies 110.

Figure 2:
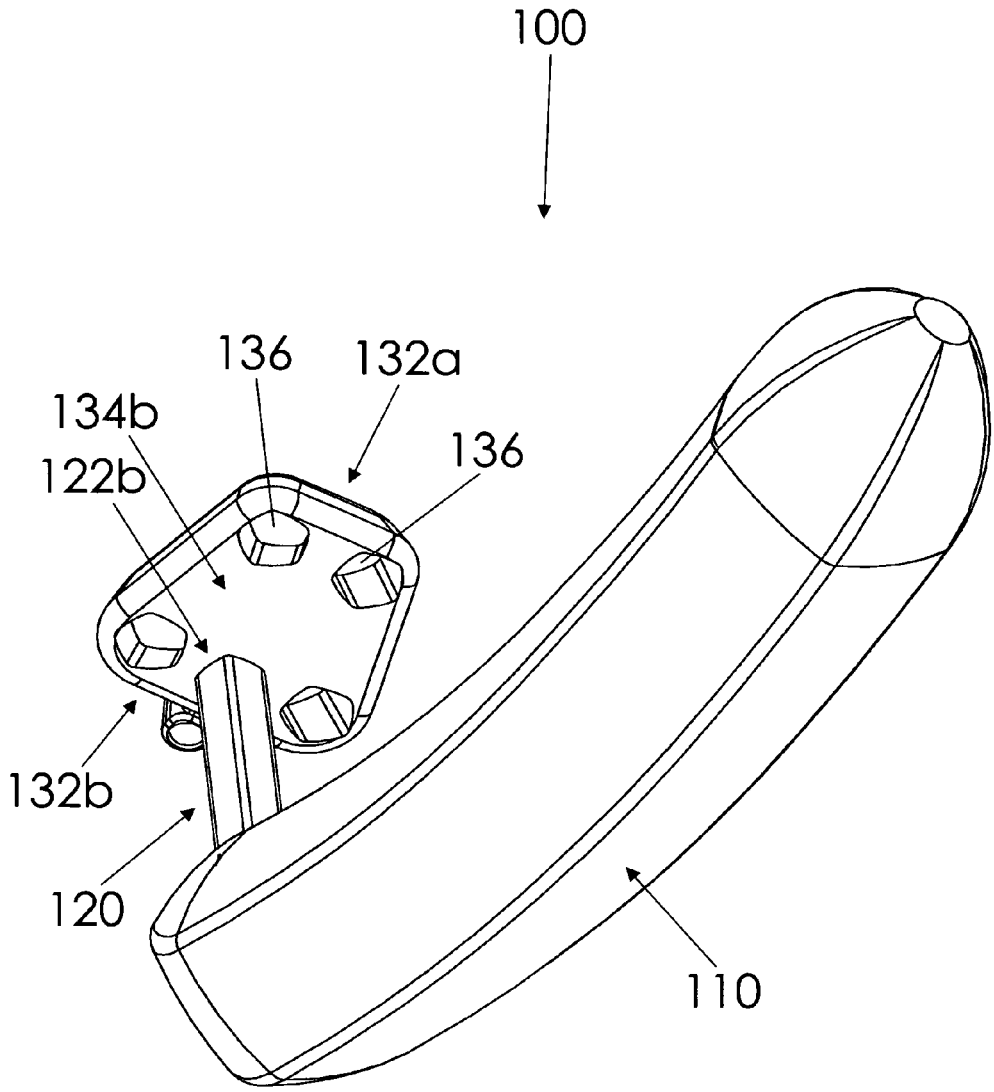
FIG. 2 is a perspective view of a single banana body in use with a stem hub.

Turning to the stem hub 130, the stem hub 130 may have front and rear ends 132*a*, 132*b* and top and bottom sides 134*a*, 134*b*. As shown in FIG. 2, the front end 132*a* may have a width that is less than a width of the rear end 132*b*, and the bottom side 134*b* may include sockets 136. In some embodiments, the bottom side 134*b* has at least two rows of sockets 136, as shown in FIG. 2. The sockets 136 are configured complementary to the stem second ends 122*b* to receive (e.g., removably receive) the stem second ends 122*b*. Each stem second end 122*b* and socket 136 may be configured such that each socket 136 receives the stem second ends 122*b* in only one arrangement to position the bodies 110 generally parallel to one another (FIG. 1) when the stems 120 are coupled to the stem hub 130, regardless of which stem 120 interacts with which socket 136. This may, for example, keep one or more of the bodies 110 from being rotated undesirably relative to the other bodies 110.

To removably secure the stems 120 to the stem hub 130, a magnetic element 129 (e.g., a rare earth magnet) may be coupled to each stem (e.g., at the second ends 122*b*) and the stem hub 130 may have at least one complementary magnetic element 139. The entire stem hub 130 may be constructed of the complementary magnetic element 139 (FIG. 3*b*), or a complementary magnetic element 139 may be included within the stem hub 130 (e.g., adjacent the sockets 136).

Figure 5:
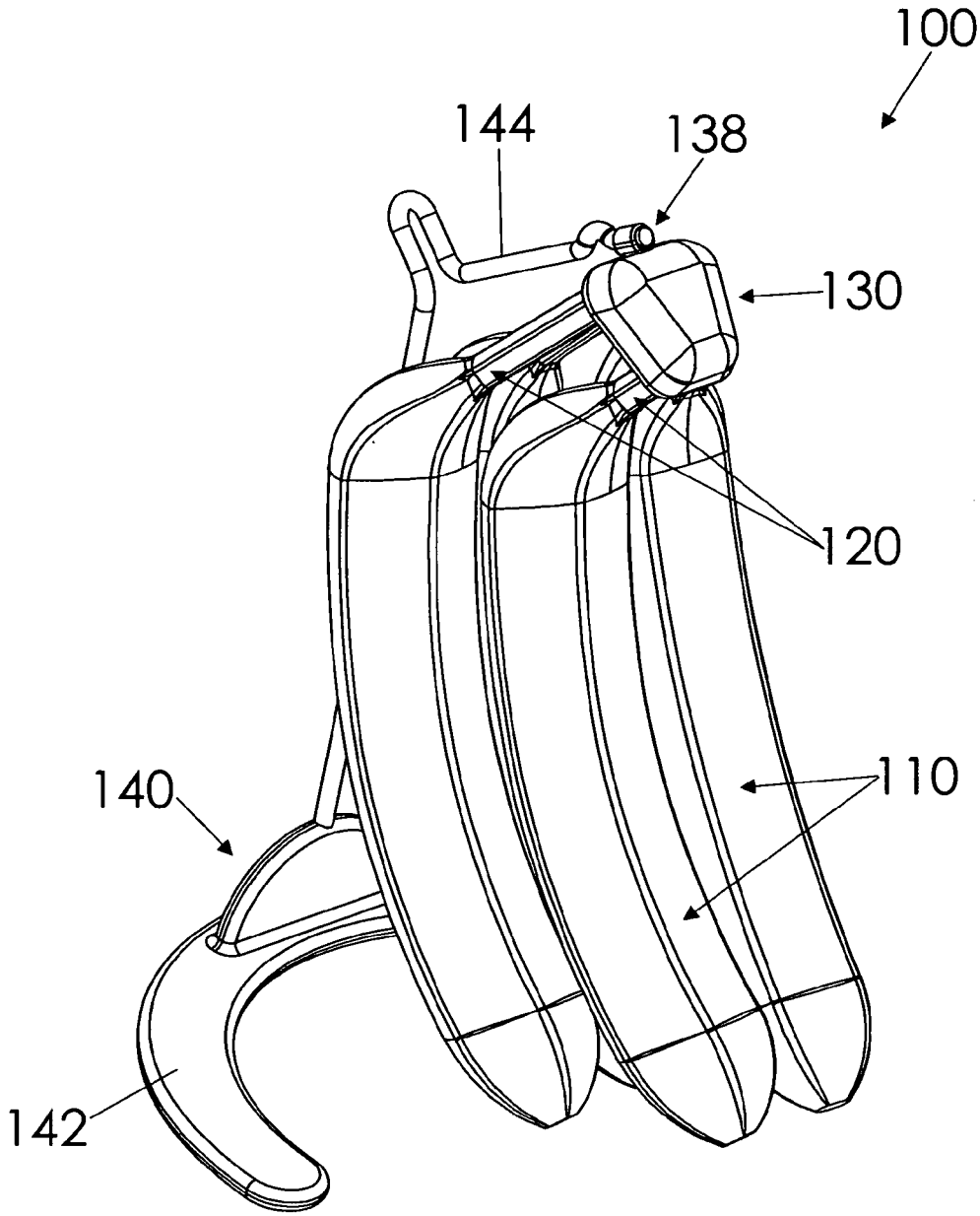
FIG. 5 is a perspective view of the banana apparatus as in FIG. 1 in use with a display stand.

As shown in FIG. 5, a display stand 140 may be included. The display stand 140 has a base 142 and an arm 144 above the base 142. The arm 144 is configured complementary to the stem hub 130 for supporting the stem hub 130 above the base 142. While the stem hub 130 is shown having an aperture 138 for receiving the arm 144, an aperture is not necessary, and the arm 144 may include a hook for supporting the stem hub 130.

In use, the bodies 110 and stems 120 may be displayed in various configurations. For example, the bodies 110 and stems 120 may be displayed with or without the stem hub 130. Especially when displaying the bodies 110 and stems 120 with the stem hub 130, the lengths of the stems 120 outside the bodies 110 may be altered by moving the stems 120 in and out of the channels 114 (FIG. 3*b*). Stems 120 with more length outside the bodies 110 may be positioned at the rear end 132*b* of the stem hub 130 when coupled to the stem hub, and stems 120 with relatively less length outside the bodies 110 may be positioned at the front end 132*a* (FIG. 1). To couple the stems 120 to the stem hub 130, the stem second ends 122*b* may be received in the sockets 136 and the magnetic elements 129, 139 may interact. The configurations of the sockets 136 and the stem second ends 122*b* may ensure that the bodies 110 point in a desired direction, as set forth above. By being able to remove various bodies 110 and stems 120 from the stem hub 130 while leaving others, and by being able to adjust the lengths of the stems 120 outside the bodies 110, realistic displays of artificial fruit may be created. Additionally, the display stand 140 may be used to hold the stem hub 130 (and the attached bodies 110 and stems 120) in realistic arrangements.

It is understood that while certain forms of this invention have been illustrated and described, it is not limited thereto except insofar as such limitations are included in the following claims and allowable functional equivalents thereof.

The invention claimed is:

1. An artificial fruit apparatus, comprising:

a plurality of artificial fruit bodies, each artificial fruit body having a proximal end and a distal end, each proximal end telescopically receiving an artificial stem to allow a length of said stem outside said artificial fruit body to be altered;

a stem hub, said stem hub includes at least one complementary magnetic element;

means for removably coupling said stem hub to plurality of said artificial stems, said means for removably coupling includes a magnetic element coupled to each artificial stem; and a display stand having a base and an arm above said base, said arm being configured complementary to said stem hub for supporting said stem hub above said base.

2. The artificial fruit apparatus of claim 1, wherein said telescopic interaction between said artificial fruit bodies and said artificial stems is a friction fit to maintain a desired length of each respective artificial stem outside respective artificial fruit bodies.

3. The artificial fruit apparatus of claim 2, wherein each said artificial stem has a generally linear configuration.

4. The artificial fruit apparatus of claim 3, wherein each said artificial fruit body is configured as a banana body.

5. The artificial fruit apparatus of claim 1, wherein:

said telescopic interaction between said artificial fruit bodies and said artificial stems is a friction fit to maintain a desired length of each respective artificial stem outside respective artificial fruit bodies; and each said artificial stem has a generally linear configuration.

6. An artificial banana apparatus, comprising:

a plurality of artificial banana bodies, each artificial banana body being elongate and curved, each artificial banana body having a stem end and an opposed tip, each stem end having a channel;

a plurality of elongate stems, each stem having a first end telescopically received in a respective channel to allow a length of said stem outside said artificial banana body to be adjusted, each stem having a second end with a magnetic element;

a stem hub having at least one magnetic element complementary to said stem magnetic elements to removably couple said stems to said stem hub, said stem hub having at least two rows of sockets complementary to said stem second ends to receive said stem second ends in at least two rows.

7. The artificial banana apparatus of claim 6, wherein said at least one magnetic element of said stem hub is adjacent said sockets.

8. The artificial banana apparatus of claim 7, wherein said telescopic interaction between said artificial banana bodies and said stems is a friction fit to maintain a desired length of each respective stem outside respective artificial banana bodies.

9. The artificial banana apparatus of claim 8, wherein each stem second end and each socket is configured such that each socket receives said stem second ends in only one arrangement to position said artificial banana bodies generally parallel to one another when said stems are coupled to said stem hub regardless of which stem interacts with which socket.

10. The artificial banana apparatus of claim 9, wherein:

said stem hub has front and rear ends; and said stem hub front end has a width that is less than a width of said stem hub rear end.

11. The artificial banana apparatus of claim 10, further comprising a display stand having a base and an arm above said base, said arm being configured complementary to said stem hub for supporting said stem hub above said base.

12. The artificial banana apparatus of claim 10, wherein said magnetic elements of said stem second ends are rare earth magnets and said stems are generally linear.

13. The artificial banana apparatus of claim 12, wherein said artificial banana bodies are constructed of at least one of plastic, wood, and metal.

14. The artificial banana apparatus of claim 13, further comprising a display stand having a base and an arm above said base, said arm being configured complementary to said stem hub for supporting said stem hub above said base.

15. The artificial banana apparatus of claim 6, wherein each stem second end and each socket is configured such that each socket receives said stem second ends in only one arrangement to position said artificial banana bodies generally parallel to one another when said stems are coupled to said stem hub regardless of which stem interacts with which socket.

16. The artificial banana apparatus of claim 6, wherein:

said stem hub has front and rear ends; and said stem hub front end has a width that is less than a width of said stem hub rear end.

17. An artificial banana apparatus, comprising:

a stem hub having front and rear ends and top and bottom sides, said front end having a width that is less than a width of said rear end, said bottom side having at least two row of sockets;

a plurality of elongate stems having first and second ends, a respective stem second end being received in each socket, said stem second ends are removably received in said sockets; each stem second end has a magnetic element; and said stem hub has at least one magnetic element complementary to said magnetic elements of said stem second ends, wherein said stem second ends are removably coupled to said stem hub;

a plurality of artificial banana bodies, each artificial banana body being elongate and curved and having a stem end and an opposed tip, each stem end having channel, a respective stem first end being telescopically received in each channel.

18. The artificial banana apparatus of claim 17, further comprising a display stand having a base and an arm above said base, and wherein:

said arm is configured complementary to said stem hub to support said stem hub above said base;

each stem second end and each socket is configured such that each socket receives said stem second ends in only one arrangement to position said artificial banana bodies generally parallel to one another when said stems are coupled to said stem hub regardless of which stem interacts with which socket; and said telescopic interaction between said artificial banana bodies and said stems is a friction fit to maintain a desired length of each respective stem outside respective artificial banana bodies.

* * * * *